US007449274B2

(12) United States Patent
Imafuku et al.

(10) Patent No.: US 7,449,274 B2
(45) Date of Patent: Nov. 11, 2008

(54) TONER FOR ELECTROSTATIC IMAGE DEVELOPMENT AND IMAGE FORMING METHOD USING THE SAME

(75) Inventors: Tatsuo Imafuku, Nara (JP); Takahiro Bito, Nara (JP); Eiji Tenjiku, Nara (JP); Takeshi Satoh, Yamatokoriyama (JP); Takeshi Ohkawa, Yamatokoriyama (JP); Akiko Tsujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 456 days.

(21) Appl. No.: 11/262,885

(22) Filed: Nov. 1, 2005

(65) Prior Publication Data

US 2006/0093947 A1 May 4, 2006

(30) Foreign Application Priority Data

Nov. 1, 2004 (JP) ..... 2004-318190

(51) Int. Cl.
*G03G 9/00* (2006.01)

(52) U.S. Cl. ..... 430/110.4

(58) Field of Classification Search ..... 430/110.4
See application file for complete search history.

(56) References Cited

U.S. PATENT DOCUMENTS

| | | | | |
|---|---|---|---|---|
| 3,969,251 | A | 7/1976 | Jones et al. | |
| 4,122,024 | A | 10/1978 | Jones et al. | |
| 5,529,865 | A * | 6/1996 | Kanbayashi et al. | 430/45.5 |
| 6,395,443 | B2 * | 5/2002 | Kuroda et al. | 430/110.4 |
| 2001/0041298 | A1 | 11/2001 | Kuroda et al. | |

FOREIGN PATENT DOCUMENTS

| | | | |
|---|---|---|---|
| JP | 51-3244 | | 1/1976 |
| JP | 54-72054 | | 6/1979 |
| JP | 58-129437 | | 8/1983 |
| JP | 6-3853 | A | 1/1994 |
| JP | 6-175391 | | 6/1994 |
| JP | 7-181747 | | 7/1995 |
| JP | 2763318 | | 3/1998 |
| JP | 2000-206733 | A | 7/2000 |
| JP | 2000-338710 | | 12/2000 |
| JP | 2000-352845 | A | 12/2000 |
| JP | 2002-31902 | A | 1/2002 |
| JP | 2003-15363 | A | 1/2003 |
| JP | 2004-126234 | A | 4/2004 |

OTHER PUBLICATIONS

Patent Abstract of Japan, JP 2002-244343, Aug. 30, 2002.

* cited by examiner

*Primary Examiner*—Mark A Chapman
(74) *Attorney, Agent, or Firm*—Nixon & Vanderhye P.C.

(57) ABSTRACT

A toner for electrostatic image development, which contains toner particles in which not more than 13 percent by number of the toner particles have a particle diameter of smaller than 4 μm, not less than 20 percent by number of the toner particles have a particle diameter of 4 μm to 6 μm, and not more than 2.0 percent by volume of the toner particles have a particle diameter of 16 μm or greater. The toner particles have a volume average diameter of 4 μm to 9 μm, and at least an external additive is added to the toner particles.

7 Claims, 2 Drawing Sheets

TONER FOR ELECTROSTATIC IMAGE DEVELOPMENT AND IMAGE FORMING METHOD USING THE SAME

CROSS-REFERENCE TO RELATED APPLICATION

This application is related to Japanese Patent Application No. 2004-318190 filed on Nov. 1, 2004, whose priory is claimed and the disclosure of which is incorporated by reference in its entirety.

BACKGROUND OF THE INVENTION

1. Field of the Invention

The present invention relates to a toner for development of an electrostatic image that can be used in image forming methods such as electrophotography, electrostatic recording and the like, and to an image forming method using the same.

2. Description of Related Art

In recent years, as image forming apparatuses such as electrophotographic copier and the like have become widely used, uses thereof have been extended to various applications and there are severe needs for higher image quality. In copying of images such as general documents, books and the like, even the microscopic characters are required to be very finely and faithfully reproduced without being crushed or broken. Where a latent image on a photoreceptor of an image forming apparatus to be reproduced is a line image having a line width of 100 μm or smaller, an ordinary plain-paper copier can not achieve a sufficient sharpness as it has a poor thin line reproducibility.

In image forming apparatuses such as electrophotographic printers and the like which use digital image signals, a latent image is formed of a pattern of dots having a certain potential. Solid areas, halftone areas and lightly shaded areas are formed by changing the dot density. However, there is a problem that toner particles can not precisely adhere to the dots and the particles lie off the outline of the dots. Because of this, the gradation of a toner image can not correspond to the dot density ratio between black and white portions in a digital latent image. Where the dot size is reduced to improve the resolution for better image quality, reproduction of a latent image formed of microscopic dots become more difficult and there is a tendency that a image with poor resolution and gradation as well as reduced sharpness is formed.

Furthermore, though the above image forming apparatuses can achieve satisfactory image quality in the beginning, there are cases where the image quality degrades as the number of copies or prints increases. It is believed that this happens because toner particles which are easier to be developed are consumed first and toner particles which are difficult to be developed accumulate and remain in a developer unit as the copying or printing continues.

In order to improve the image quality, there has been proposed a number of developers. In Japanese Unexamined Patent Publication No. SHO 51(1976)-3244, for example, a toner with a limited particle diameter distribution is proposed for the improvement of image quality. In this patent publication, it is described that the toner in which not less than about 60 percent by number of toner particles have a particle diameter of 8 μm to 12 μm is most desirable. However, the toner particles in this particle diameter range are relatively coarse, and according to the study made by the present inventors, it is still difficult to make the toner of this particle sizes to closely adhere to a latent image. Furthermore, the toner of this patent publication is characterized by comprising toner particles having an average particle diameter of 5 μm or smaller in an amount of not more than 30 percent by number and toner particles having an average particle diameter of 20 μm or smaller in an amount of not more than 5 percent by number. This wide range of particle diameter distribution tends to reduce the uniformity of the toner. Therefore, in order to form a sharp image using the toner of the aforementioned patent publication comprising coarse toner particles and having a wide particle diameter distribution range, the toner particles need to be thickly overlaid to fill space between the particles so that the apparent image density increases. This results in an increase in toner consumption necessary for obtaining a predetermined image density.

In Japanese Unexamined Patent Publication No. SHO 54(1979)-72054, there is proposed a toner having narrower particle diameter distribution than that of the toner of aforementioned patent publication. However, middle-weight particles have a coarse particle diameter of 8.5 μm to 11.0 μm and further improvement needs to be made to obtain a high-resolution toner.

In Japanese Unexamined Patent Publication No. SHO 58(1983)-129437, there is proposed a toner in which the average particle diameter of toner particles is 6 μm to 10 μm and particles of 5 μm to 8 μm in diameter occupy the largest number. Since the number of toner particles with a particle diameter of 5 μm or smaller is as small as 15 percent by number, images with reduced sharpness tend to be formed.

In Japanese Patent No. 2763318, a toner contains toner particles having a particle diameter of 5 μm or smaller in an amount of 17 to 60 percent by number so as to inhibit a change in toner properties associated with long use thereof. Though the toner of this patent withstands use for about hundred thousand copies or prints, recent machines aiming for longer machine life require durability to withstand use for about five hundred thousand copies or prints, and when this toner is used in such machines, toner particles with poor developability accumulate and remain in a developer unit, and thus, the durability is not sufficient.

According to the study made by the present inventors, it is found that toner particles with particle diameter of 4 μm to 5.04 μm can clearly reproduce the outline of a latent image and play an important role in making toner to closely adhere to the entire latent image.

Particularly, since lines of electric force are concentrated at the edge (outline) of the image and thereby the edge of the image is higher in field intensity than the inner portion of the image, the sharpness of the image depends on the quality of toner particles concentrated in this area. It is found by the present inventors that the toner particles with a particle diameter of 4 μm to 5.04 μm are effective in solving this problem related to image sharpness. Furthermore, it is found that toner particles with a particle diameter smaller than 4 μm accelerate degradation of developers, and thus, reduction of the number of such particles is a main factor for achieving longer toner life.

SUMMARY OF THE INVENTION

According to an aspect of the invention, there is provided a toner for electrostatic image development, comprising toner particles in which not more than 13 percent by number of the toner particles have a particle diameter of smaller than 4 μm, not less than 20 percent by number of the toner particles have a particle diameter of 4 μm to 6 μm, not more than 2.0 percent by volume of the toner particles have a particle diameter of 16 μm or greater, wherein the toner particles have a volume average diameter of 4 μm to 9 μm and at least an external additive is added to the toner particles.

According to another aspect of the invention, provided is the toner which is used in an image forming apparatus, the image forming apparatus comprising: an image bearing member; electrostatic latent image forming means for forming an electrostatic latent image on the supporter; developer supply means for supplying a developer to the supporter to form a toner image; transportation means for transporting a transfer material to a transfer position on the supporter; and transfer means for transferring the toner image from the supporter to the transfer material at the transfer position.

In accordance with a still another aspect of the invention, there is provided an image forming method comprising the steps of: forming an electrostatic latent image on an image bearing member; supplying to the image bearing member a two-component developer containing at least a toner and magnetic carriers to form a toner image; and transferring the toner image to a transfer material, wherein the toner comprises the aforementioned toner.

According to the present invention, the toner for electrostatic image development and image forming method using the toner can achieve at least one of the following effects:

(1) Can form a toner image which has a high image density and is excellent in thin-line reproducibility and gradation. In other words, even a thin line in a latent image formed on an image bearing member (photoreceptor) can be precisely reproduced, and an image excellent in gradation, resolution and in reproduction of a latent image of dots can be formed;

(2) Can suppress a change in toner properties associated with longtime use;

(3) Can suppress a change in toner properties associated with an environmental change;

(4) Can achieve excellent transferability;

(5) Can obtain a high image density with less toner consumption. In other words, even a high-density image can be satisfactorily developed with less toner consumption than with conventional toner, and thus, the inventive toner is economical and is advantageous in reducing the size of a copier or a printer; and (6) Can form a toner image excellent in resolution, gradation and thin-line reproducibility when the inventive toner is used in an image forming apparatus using digital image signals.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
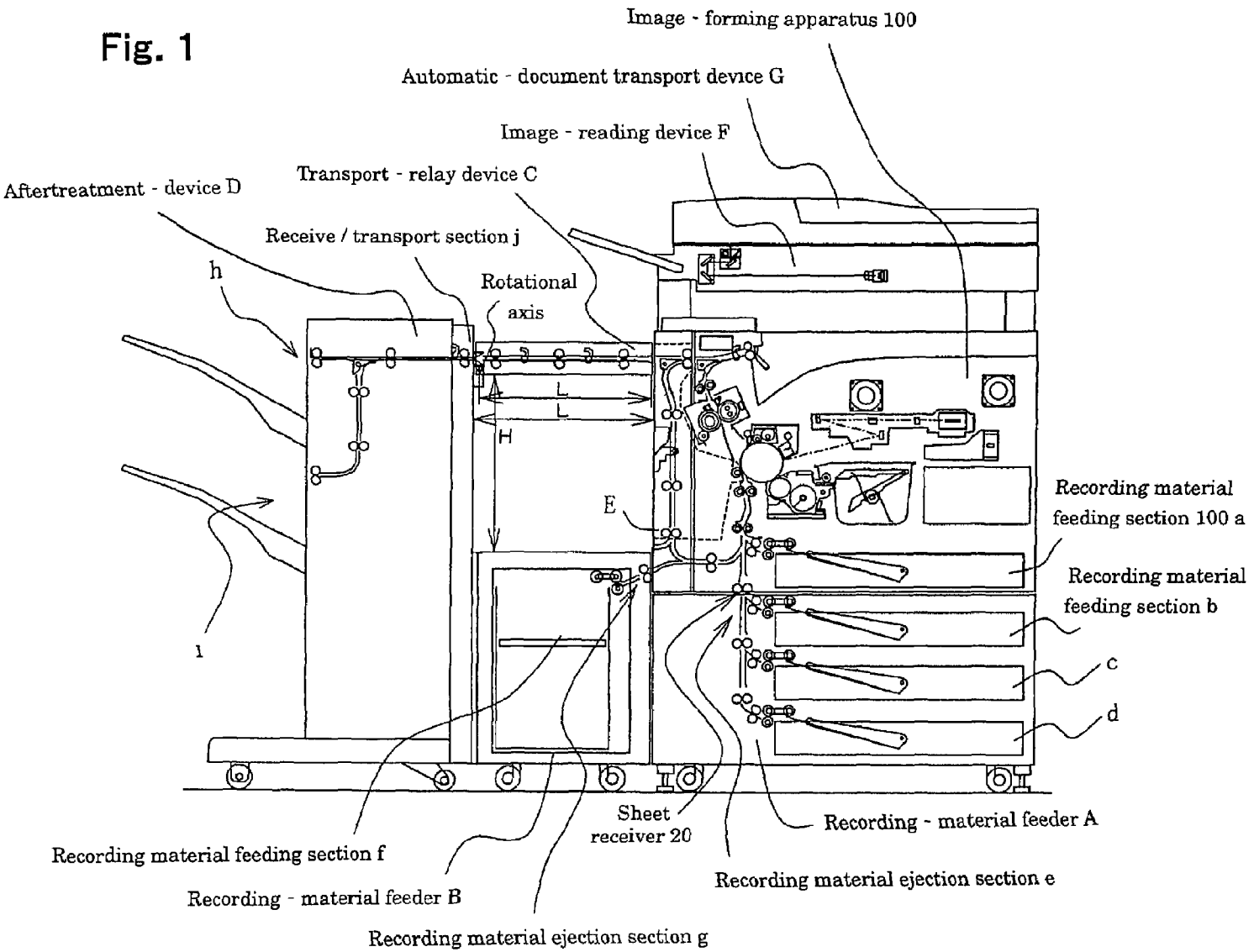
FIG. 1 is an explanatory view of the general construction of a copier including an image forming apparatus.

According to the present invention, by "toner" is meant toner having a saturation magnetization of 0 emu/g to 10 emu/g in an external magnetic field of 5000 oersted (Oe).

It is presumed that the toner of the invention can achieve the aforementioned effects (1) to (6) for the following reasons.

Conventionally, it has been believed in the art that the amount of toner particles with a particle size of 5 μm or smaller needs to be aggressively reduced, because charge amount control is difficult, flowability of toner is spoiled, and they cause apparatus contamination when toner scatters and also cause fogging of an image.

However, the study made by the present inventors has revealed that such problems are caused by toner particles of smaller than 4 μm in diameter while toner particles of 4 μm to 5 μm in diameter are an essential component for forming a high-quality image. Thus, one of the characteristics of the toner of the invention is that it contains toner particles having a particle diameter of smaller than 4 μm in a smaller amount, that is, not more than 13 percent by number of a total toner particle number.

According to the invention, it is preferred that not more than 10 percent by number of the toner particles have a particle diameter of smaller than 4 μm, not less than 25 percent by number of the toner particles have a particle diameter of 4 μm to 5.04 μm, not more than 0.5 percent by volume of the toner particles have a particle diameter of 16 μm or greater, and the toner particles have a volume average diameter of 6.7 μm to 7.7 μm.

The toner of the invention contains an external additive. Preferably, the external additive is fine silica powder with an average particle diameter of 4 μm or smaller, and the additive is added in an amount of 0.01 to 8 parts by weight relative to 100 parts by weight of the toner particles.

The toner of the invention may be used together with magnetic carriers as a two-component developer. The magnetic carriers preferably have a volume average diameter of 30 μm to 100 μm and are preferably used in an amount of 10 to 1000 parts by weight relative to 10 parts by weight of the toner.

The present inventors determined a toner particle diameter distribution, for example, in the following manner. Latent images were formed by changing the surface potential on a photoreceptor: from a contrast having a high development potential at which a large number of toner particles are easily developed, to a halftone and further to a contrast having a low development potential at which only a very few toner particles are developed. Then, the latent images were developed using a two-component developer containing toner particles having a particle diameter distribution over 0.5 μm to 30 μm, and the toner particles developed on the photoreceptor were collected for the measurement. It is found that there were a large number of toner particles with a particle diameter in the range of 4 μm to 8 μm. It is also found that among the particles of 4 μm to 8 μm in diameter, those suitable for development have a particle diameter of 4 μm to 6 μm and more preferably, 4 μm to 5.04 μm. The toner particles in this diameter range can, when developing a latent image on a photoreceptor, precisely adhere to the latent image without lying beyond the image and form a toner image excellent in reproducibility of thin lines. According to the present invention, 20 to 40 percent by number, and more preferably 20 to 30 percent by number of the toner particles have a particle diameter of 4 μm to 6 μm, and preferably 4 μm to 5.04 μm. A toner containing the toner particles in this diameter range by the aforementioned percent by number displays excellent reproducibility as described above.

In the toner for electrostatic image development according to the present invention, as described above, not more than 13 percent by number of the toner particles have a particle diameter of smaller than 4 μm. Where more than 13 percent by number of the toner particles have a particle diameter of smaller than 4 μm, the number of effective toner particles decreases as the toner is continuously used in making copies or prints with a copier or a printer. This makes the toner particle diameter distribution to be unbalanced, whereby the image quality gradually decreases. In other words, it is thought that the smaller particles with a particle diameter of smaller than 4 μm have a greater amount of charge and an increased Van der Waals force, and this allows them to strongly adhere to carrier surfaces and accumulate in a developer. Where the percentage of such microscopic toner particles in the total toner particles is higher than 13 percent by number, toner particles with a particle diameter of 4 μm or greater have a less chance to be in contact with carriers and charged as toner particles are additionally supplied, thereby resulting in a toner with low charge. The low-charged toner is liable to cause fogging and scattering. The toner of the invention may not contain toner particles of less than 4 μm in diameter.

In the toner of the invention, not more than 2.0 percent by volume, preferably not more than 1.0 percent by volume, and more preferably not more than 0.5 percent by volume of the toner particles have a particle diameter of 16 μm or greater. Where more than 2.0 percent by volume of the toner particles have a particle diameter of 16 μm or greater, reproduction of thin lines is hindered. Furthermore, where coarse toner particles of 16 μm or greater in diameter are prominent in a thin layer surface of toner particles developed on a photoreceptor, the adhesion of a transfer paper to the photoreceptor via the toner layer becomes nonuniform, causing the transfer conditions to change. This may lead to formation of an incompletely transferred image. The toner of the invention may not contain toner particles with a particle diameter of 16 μm or greater.

In the toner of the invention, the toner particles have a volume average diameter of 4 μm to 9 μm, and preferably 4 μm to 8 μm. These values can not be considered separately from the aforementioned constituent features of the invention. With the toner particles having a volume average diameter of smaller than 4 μm, only a small amount of toner adheres to a transfer paper when the toner is used for such applications as formation of graphic images having a higher graphical area percentage. As a result, there occurs a problem of image density reduction. It is believed that this problem happens for the same reason as that for the inner portion being lower in density than the edge in a latent image. On the other hand, where the volume average diameter exceeds 9 μm, the resolution and image quality tend to decrease over long period of use even though they are satisfactory in the beginning of copy or printing.

The toner particle diameter distribution can be determined by various methods. In the present invention, the toner particle diameter distribution is determined in the following manner.

As a measuring instrument, a coulter counter TA-II (manufactured by Coulter, Inc.) is used. An interface (manufactured by Nikkaki Bios., Ltd.) for outputting a number distribution and a volume distribution, and a personal computer (manufactured by Sharp Corporation) are connected to the coulter counter. First-grade sodium chloride is used as an electrolytic solution to prepare 1% NaCl aqueous soulution. Into 100 ml-500 ml of the electrolytic aqueous solution, 0.1 ml-5 ml of a surface active agent as a dispersant, preferably an alkylbenzenesulfonate is added and 2 mg-20 mg of a toner as a measurement sample is added. Dispersion of the electrolytic solution having the sample suspended therein is performed in an ultrasonic distributor for about 1 to 3 minutes, and employing a 100 μm aperture, the particle diameter distribution relative to the number of particles is determined with the coulter counter TA-II. From the determined particle diameter distribution, values such as a number %, volume %, volume average diameter and the like can be obtained.

The measurement method described above uses Coulter Principle. The Coulter Principle is a principle that utilizes electric resistance, and measures a change in electric resistance generated between two electrodes when particles pass through a sensitive region. The electric resistance is proportional to the volume of the particles. The amount of electrolytic solution that flows through the aperture is accurately controlled, and the sphere equivalent diameter and number of particles can be determined from a precise volume of the particles.

In the present invention, by the term "particle diameter" is meant "sphere equivalent diameter" measured by the coulter counter TA-II. Furthermore, the volume average diameter D is defined as $D=D_{50}\exp(3.5\ln^2\sigma)$ in which $D_{50}$ is a 50% diameter relative to a particle number and $\sigma$ is a geometric standard deviation.

Examples of binding resin that can be used in the toner of the invention are: monopolymers of styrene and its substituted derivatives such as polystyrene, poly-p-chlorstyrene and polyvinyl toluene; styrene-based copolymers such as styrene-p-chlorstyrene copolymer, styrene-vinyl toluene copolymer, styrene-vinyl naphthalin copolymer, styrene-acrylic ester copolymer, styrene-methacrylic ester copolymer, styrene-α-chlormethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride; phenolic resin; natural modified phenolic resin; natural resin modified maleic acid resin; acrylic resin; methacrylic resin; polyvinyl acetate; silicone resin; polyester resin; polyurethane; polyamide resin; furan resin; epoxy resin; xylene resin; polyvinyl butyral; terpene resin; coumarone-indene resin; and petroleum-based resin.

Significant problems associated with heat pressure roller fixing which barely uses (applies) oil are offsets in which a toner image on a toner image supporting member is partly transferred to a roller, and a decrease in adhesion of toner to the toner image supporting member. Since a toner that are fixed with less heat energy has a property that toner blocking or caking is apt to take place during normal storage or in a developer unit, these problems need to be taken into consideration. For this reason, when using the toner of the invention in heat pressure roller fixing that barely uses oil, choice of binding resin is important. Preferable binding materials include crosslinked styrene-based copolymers and crosslinked polyesters.

Examples of a comonomer that can be polymerized with a styrene monomer for preparation of the styrene-based copolymers include: monocarboxylic acids having a double bond and their substituted derivatives such as acrylic acid, methyl acrylate, ethyl acrylate, butyl acrylate, dodecyl acrylate, octyl acrylate, 2-ethylhexyl-acrylate, phenyl acrylate, methacrylic acid, methyl methacrylate, ethyl methacrylate, butyl methacrylate, octyl methacrylate, acrilonitrile, metacrylonitrile and acryl amide; dicarboxylic acids having a double bond and their substituted derivatives such as maleic acid, butyl maleate, methyl maleate, and dimethyl maleate; and vinyl monomers including vinyl esters such as vinyl chloride, vinyl acetate and vinyl benzoate; ethylene-based olefins such as ethylene, propylene and butylene; vinyl ketones such as vinyl methyl ketone, and vinyl hexyl ketone; and vinyl ethers such as vinyl methyl ether, vinyl ethyl ether and vinyl isobutyl ether. These comonomers can be used alone or two or more of these can be used in combination.

As a crosslinking agent, a compound having two or more double bonds that can be polymerized is mainly used. Examples of such compound include: aromatic divinyl compounds such as divinylbenzene and divinylnaphthalene; carboxylic acid ester having two double bonds such as ethylene glycol diacrylate, ethylene glycol dimethacrylate and 1,3-butanediol dimethacrylate; divinyl compounds such as divinylaniline, divinyl ether, divinyl sulfide and divinyl sulfone; and compounds having three or more vinyl groups. These compounds can be used alone or as a mixture. In view of offset resistance and adhesion of the toner, the crosslinking agent is preferably used in an amount of 0.01 wt % to 10 wt %, and more preferably in an amount of 0.05 to 5 wt % relative to the binding resin when synthesizing the binding resin.

As a release agent, polyethylene, polypropylene, polymethylene, a polyurethane elastomer, an ethylene-ethylacrylate copolymer, an ethylene-vinyl acetate copolymer, ionomer resin, a styrene-butadiene copolymer, a styrene-isopurene copolymer, a linear saturated polyester or paraffin can be used.

The toner of the invention can be used as a toner for multicolor or full-color image formation. A color toner image can be formed in the following manner: light is passed from a document through a color-resolution light transparent filter which complements colors of the toner, to form an electrostatic latent image on a photoconductive layer; development and transfer are performed so that the toner is supported on a supporting member; and after repeating the above steps for several times, the toner is overlaid on the same supporting member while the registration is adjusted. Thus, a final full-color image can be obtained in one fixation.

As the toner, yellow toner, magenta toner and cyan toner are used, and in some cases, black toner is further used. When the toner of the invention is used in nonmagnetic color toner to serve as toner for full-color image formation, a satisfactory color image excellent in color mixability and gloss can be formed. In such case, non-crosslinked polyester resin having a low viscosity at a fixing temperature is preferably used as the binder resin in view of color mixability.

The toner of the invention preferably contains a charge control agent in toner particles. With the charge control agent, the charge amount can be controlled to best suit a development system, and particularly in the present invention, the balance between the particle diameter distribution and the charge can be more stabilized. By using the charge control agent, the aforementioned respective functions of toner particles in different diameter ranges for improving the image quality can be made distinct and the complementary roles of these toner particles in different diameter ranges can also be clarified.

As a positive charge control agent, a denatured nigrosine or metal salt of fatty acid; a quaternary ammonium salt such as tributylbenzylammonium-1-hydroxy-4-naphtholsulfonate or tetrabutylammoniumtetrafluoroborate; a diorganotin oxide such as dibutyltin oxide, dioctyltin oxide or dicyclohexyltin oxide; or a diorganotin borate such as dibutyltin borate, dioctyltin borate or dicyclohexyltin borate can be used alone or two or more of these can be used in combination. Among these, the nigrosine and quaternary ammonium salt are preferably used.

As a negative charge control agent usable in the invention, for example, an organometallic complex and a chelate compound are effective. Examples of the organometallic complex and chelate compound include: aluminum acetylacetonate, iron II acetylacetonate and chromium 3,5-di-tert-butylsalicylate. Among these, an acetylacetone metal complex (including those substituted with monoalkyl and those substituted with dialkyl), a salicylic acid based metal complex (including those substituted with monoalkyl and those substituted with dialkyl), or salts thereof are preferred. In particular, an organometallic complex and a salicylic acid based metal salt are more preferred.

The aforementioned charge control agents (those that do not act as a binding resin) are preferably used in the form of fine particles. When used in fine particles form, the charge control agent preferably has a number average diameter of 4 μm or smaller, and more preferably 3 μm or smaller. When the toner particles are impregnated with the charge control agent, the charge control agent is preferably used in an amount of 0.1 to 20 parts by weight, and more preferably in an amount of 0.2 to 10 parts by weight relative to 100 parts by weight of the binding resin.

The toner of the invention preferably has fine powder added as an external additive to the toner particles. As the external additive, fine silica powder, fine titanium oxide powder ($TiO_2$) having a BET specific surface area of 50 $m^2/g$ to 400 $m^2/g$ or a mixed powder of fine silica powder and fine titanium oxide powder can be used. Among these, the fine silica powder is preferred.

The toner having such a particle diameter distribution as defined in the present invention is greater in specific surface area than conventional toners. Therefore, when the toner particles are brought into contact with surfaces of carriers or conductive cylindrical sleeves having a field generating means therein, the number of contacts made between the toner particle surfaces and carriers/sleeves increases as compared to the conventional toners, whereby abrasion of the toner particles and contamination of the carrier/sleeve surfaces tend to occur. When the toner of the invention and the fine silica powder are mixed, the external additive appears between the toner particles and the carrier/sleeve surfaces, thereby significantly reducing the abrasion of toner particles. As a result, the toner and the carriers/sleeves can have longer life, and a stable charge can be maintained. Thus, there can be provided a monocomponent developer or a two-component developer containing the toner and the carriers that can display excellent properties in long period of use.

The toner particles of 4 μm to 6 μm (preferably 4 μm to 5.04 μm) in diameter, which play an important role in the present invention, become more effective in the presence of the fine silica powder as the external additive, and thus, able to stably provide high-quality images. As the fine silica powder, those produced by both dry and wet processes can be used. In view of filming resistance and durability, fine silica powder produced by dry process is preferred. By the dry process is meant a process for preparing fine silica powder by, for example, vapor-phase oxidation of a silicon halide. As the wet process for preparing the fine silica powder used in the invention, various known processes can be employed.

As the silica powder of the invention, anhydrous silicon dioxide (colloidal silica); or a silicate such as aluminum silicate, sodium silicate, potassium silicate, magnesium silicate or zinc silicate can be used. Among the aforementioned fine silica powders, those having a specific surface area of 30 $m^2/g$ or greater (particularly, 50 $m^2/g$ to 400 $m^2/g$) as measured by nitrogen absorption using BET procedure can produce an excellent result. Such fine silica powder is preferably used in an amount of 0.01 to 8 parts by weight, and more preferably 0.1 to 5 parts by weight relative to 100 parts by weight of nonmagnetic toner.

When the toner of the invention is used as a positively charged toner, the fine silica powder added thereto, for the prevention of toner abrasion and contamination of carrier/sleeve surfaces, is preferably positively charged rather than negatively charged in view of the charge stability. As a process for obtaining positively charged fine silica powder, there can be used a process in which the aforementioned untreated fine silica powder is treated with silicone oil having an organo group having at least one or more nitrogen atom in its side chain, a process or treating the fine silica powder with a silane coupling agent containing nitrogen, or a method which uses both of the above processes.

In the present invention, by the positively charged silica is meant silica having a positive tribocharge to iron-powder carriers when measured by blowoff procedure. As the silicone oil, which has a nitrogen atom in its side chain, used for the treatment of fine silica powder, any known silicone oil can be used. The silicone oil is used in an amount of 1 to 50 percent by weight, and preferably in an amount of 5 to 30 percent by weight relative to the silica powder.

Examples of the nitrogen-containing silane coupling agent used in the invention include: aminopropyltrimethoxysilane, aminopropyltriethyoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine. As the nitrogen-containing heterocyclic ring, those with the aforementioned structure can be used. Examples of such compounds include trimethoxysilyl-γ-propylpiperidine, trimethoxysilyl-γ-propylmorpholine and trimethoxysilyl-γ-propylimidazole. The silane coupling agent is used in an amount of 1 to 50 percent by weight, and preferably in an amount of 5 to 30 percent by weight relative to the fine silica powder.

The treated positively charged fine silica powder is preferably used in an amount of 0.01 to 8 parts by weight relative to 100 parts by weight of the positively charged toner in order to display its effect, and more preferably used in an amount of 0.1 to 5 parts by weight relative to 100 parts by weight of the positively charged toner in order to display positive charges excellent in stability. It is preferred that the treated fine silica powder in an amount of 0.1 to 3 parts by weight relative to 100 parts by weight of the positively charged toner adheres to the surface of toner particles. The above-mentioned untreated fine silica powder may be used in the same amount.

The fine silica powder used in the invention may be treated with, upon necessity, the silane coupling agent or a treatment such as an organosilicon compound for imparting hydrophobicity. Such treatments may react with or be physically adsorbed to the fine silica powder. Examples of such treatments include: hexamethyldisilazane, trimethylsilane, trimethylchlorsilane, trimethylethoxysilane, dimethyldichlorsilane, methyltrichlorsilane, allyldimethylchlorsilane, allylphenyldichlorsilane, benzyldimethylchlorsilane, brommethyldimethylchlorsilane, α-chlorethyltrichlorsilane, β-chlorethyltrichlorsilane, chlormethyldimethylchlorsilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2-12 siloxane units per molecule and contains a hydroxyl group bonded to Si at the terminal. These treatments may be used alone or two or more of these may be used in combination. The aforementioned treatments are preferably used in an amount of 1 to 40 percent by weight relative to the fine silica powder. It is important that the final fine silica powder has negative charge.

According to the present invention, fine powder of a fluorine-containing polymer (e.g., fine powder of polytetrafluoroethylene, polyvinylidenefluoride or a tetrafluoroethylene-vinylidenefluoride copolymer) is preferably added to the toner. Particularly, the fine polyvinylidenefluoride powder is preferred in view of flowability and abrasiveness. The fine fluorine-containing polymer powder is preferably added in an amount of 0.01 to 2.0 percent by weight, preferably in an amount of 0.02 to 1.5 percent by weight, and more preferably in an amount of 0.02 to 1.0 percent by weight relative to the toner.

The toner in which the fine silica powder and the fine fluorine-containing polymer powder are mixed can stabilize the state of silica adhering to the toner particles, and for example, silica adhering to the toner particles does not liberate from the toner particles, so that the effect of preventing the toner abrasion and carrier/sleeve contamination is not reduced. Such toner can also increase the charge stability.

As a coloring agent, conventionally known dyes and pigments can be used. For example, carbon black, phthalocyanine blue, peacock blue, permanent red, lake red, rhodamine lake, Hanza yellow, permanent yellow, benzidine yellow and the like can be used. The coloring agent is contained in an amount of 0.1 to 20 parts by weight, and preferably in an amount of 0.5 to 20 parts by weight relative to 100 parts by weight of the binding resin. For improving the transparency of an OHP film to which a toner image is fixed, the coloring agent is preferably contained in an amount of not more than 12 parts by weight, and more preferably in an amount of 0.5 to 9 parts by weight relative to 100 parts by weight of the binding resin.

The toner of the invention may optionally contain other additives. Examples of other additives include: lubricants such as zinc stearate; abrasives such as cerium oxide and silicon carbide; flowability-imparting agents such as colloidal silica and aluminum oxide; anticaking agents; and conductivity-imparting agents such as carbon black and tin oxide. When the conductivity-imparting agent, for example, carbon black or tin oxide is added in an amount of 0.1 to 5 percent by weight, excessive charge on the sleeves can be suppressed and a stable charge state can be maintained. The addition of fine spherical resin powder having an average particle diameter of 0.05 μm to 3 μm, and preferably 0.1 μm to 1 μm can achieve similar effects and is effective in improving the sharpness of an image. The fine spherical resin powder is added in an amount of 0.01 to 10 percent by weight, preferably in an amount of 0.05 to 5 percent by weight, and more preferably in an amount of 0.05 to 2 percent by weight. It is preferred that the fine spherical resin powder is oppositely charged to or weakly charged with the charge of the toner.

The fine spherical resin powder is preferably formed of a vinyl-based polymer or copolymer, and in particular, an alkyl methacrylate ester polymer or copolymer is preferred.

In an preferred embodiment, a waxy material such as low-molecular weight polyethylene, low-molecular weight polypropylene, microcrystalline wax, carnauba wax, sazole wax or paraffin wax in an amount of 0.5 to 5 percent by weight may be added to the toner in order to improve the releasability at the time of heat roll fixing.

As the carriers usable in the present invention, there can be used, for example, magnetic powders such as iron powder, ferrite powder and nickel powder and these powders with their surface covered with resin; glass beads or nonmagnetic metal oxide powders and nonmagnetic metal oxide particles with their surface covered with resin. The carriers may be used in an amount of 10 to 1000 parts by weight, and preferably in an amount of 30 to 500 parts by weight relative to 10 parts by weight of the toner. The magnetic carriers (hereinafeter also referred to as magnetic particles) preferably have a volume average diameter of 30 μm to 100 μm in view of good matching with the toner of small particle diameter.

For preparation of the toner according to the invention, vinyl and non-vinyl thermoplastic resins, optionally with pigments or dyes as the coloring agent, the charge control agent and other additives, are sufficiently mixed in a mixer such as a ball mill. The mixture is then melt, mixed and kneaded using a heat kneader such as a heat roll, a kneader and an extruder so that the resins are compatibilized, and then the pigments or dyes are dispersed or melted in the mixture. After cooling and setting, grinding and strict classification are carried out to obtain the toner of the invention.

The two-component developer of the invention may include nonmagnetic toner and magnetic particles. An image forming apparatus and method used the invention employing the two-component developer will be described below with reference to FIG. 1 and FIG. 2.

Image Forming Apparatus

Figure 2:
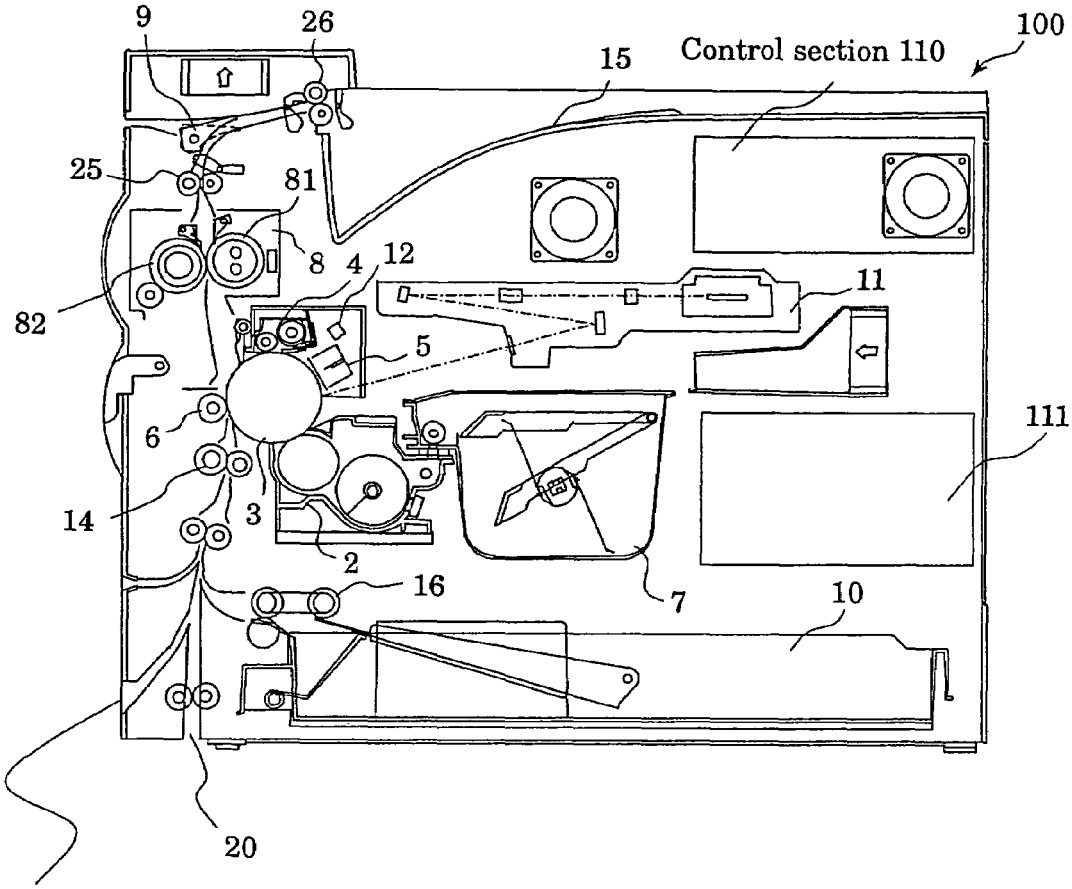
FIG. 2 is a view of the general construction of the image forming apparatus.

FIG. 1 is an explanatory view of the general construction of a copier including an image forming apparatus. FIG. 2 is an view of the general construction of the image forming apparatus.

The image forming apparatus 100 is an apparatus for recording and outputting an image read by an under-mentioned image reader F or data from a device (e.g., an image processing device such as a personal computer) externally connected to the apparatus 100 as an image.

The apparatus 100 has processing units, including a photoreceptor drum 3, for performing image forming processes disposed therein. These processing units form an image forming section. In the periphery of the drum 3, a charging means 5, a light-scanning unit 11, a development unit 2, a transfer means 6, a cleaning unit 4 and a discharge lamp 12 are disposed.

The charging means 5 uniformly charges the surface of the drum 3. The light-scanning unit 11 scans a light image on the uniformly charged drum 3 to write an electrostatic latent image. The development unit 2 develops the latent image written by the light-scanning unit 11 using a developer supplied from a developer reservoir 7, that is, using a two-component developer containing the toner of the invention and carriers. The transfer means 6 transfers the image developed on the drum 3 to a recording material (transfer material). The cleaning unit 4 removes a developer residue on the drum 3 so that a new image can be recorded on the drum 3. The discharge lamp 12 removes the charge on the surface of the drum 3.

In the bottom of the image forming apparatus 100, a recording material feeding section 100*a* including a feeding tray 10 is integrally disposed in the apparatus 100. The feeding tray 10 is a tray for housing the recording material (sheets of paper). The sheets of paper housed in the feeding tray 10 are separated one by one by means of a pickup roller 16 or the like, and each sheet is transported to a resist roller 14. The sheets are then sequentially transported to pass between the transfer means 6 and the drum 3 while being timed by the resist roller 14 to match the image formed on the drum 3. Thus, the image recorded/reproduced on the drum 3 is transferred onto the sheets. Sheets of paper can be added to the feeding tray 10 by pulling the tray 10 toward the front side (operation side) of the apparatus 100.

In the bottom of the image forming apparatus 100, a sheet receiver 20 and an expanded receiving section 21 are provided for receiving sheets delivered from peripheral devices such as a recording material feeder A having multistage recoding material feeding trays and a recording material feeder B capable of housing a vast amount of sheets, and for sequentially supplying the sheets to the image forming section.

In the upper portion of the apparatus 100, a fixing device 8 is disposed for sequentially receiving the sheets on which the image is transferred and fixing the developed image transferred on the sheets by heat and pressure using a fixing roller 81 and a pressure roller 82. Thus, the image is recorded on the sheets.

The sheets on which the image is recorded are transported upward by a transportation roller 25 and pass through a switching gate 9. Where a loading tray 15, which is provided on the exterior surface of the apparatus 100, is designated as an exit tray, the sheets are ejected by a reverse roller 26 to the loading tray 15. On the other hand, where the duplex image forming or an after-treatment is instructed, the sheets are ejected by the reverse roller 26 toward the loading tray 15. In this case, however, each of the sheets is not fully ejected and the reverse roller 26 is reversed while sandwiching each sheet. Then, the sheet is inversely transported in an opposite direction, that is, in a direction where a recording material resupply/transport device and an aftertreatment device which are selectively provided for the duplex image forming and after treatments are disposed.

When inversely transporting the sheets, the switching gate 9 is switched from the position indicated in a solid line to the position indicated in a broken line in FIG. 2. When forming duplex images, the inversely transported sheets pass through the recording material resupply/transport device and supplied to the image forming apparatus 100 again. When performing an after treatment, the sheets are transported from a recording material retransport device to the aftertreatement device via a transport relay device by another switching gate.

In the spaces above and below the light scanning unit 11, there are provided a control section 110 for housing a circuit substrate that controls image forming processes and an interface substrate that receives image data from external devices, and a power source 111 for feeding electric power to the interface substrate and image forming processing units, respectively.

Recording Material Feeder A

As shown in FIG. 1, the recording material feeder A includes recording material feeding sections b, c, d and a recording material ejecting section e. The recording material feeding sections b to d house sheets of paper, respectively. The recording material feeder A selectively operates the recording material feeding sections b to d selected by a user and separately feeds the sheets housed in these sections b to d to the recording material ejecting section e. The recording material feeder A also serves as a unit having a desk function for supporting the image forming apparatus 100, and is detachably attached to the image forming apparatus 100.

When the recording material feeder A feeds a sheet, the sheet is transported the sheet receiver 20 provided at the bottom of the apparatus 100 and further to the image forming section.

Sheets of paper can be added to the recording material feeding sections b to d or sheets of paper housed in the sections b to d can be replaced by pulling forward (toward the side a user is standing) feeding trays in the sections b to d. Though in this embodiment the recording material feeder A is comprised of three feeding sections b to d, the feeder A may include only one or more than three feeding sections and the eject section.

Recording Material Feeder B

As shown in FIG. 1, a recording material feeder B includes a recording material feeding section f. The feeding section f houses sheets of paper. The feeder B operates the feeding section f and separately feeds the sheets housed in the feeding section f to a recording material ejecting section g provided at an upper portion of a right side surface of the feeder B. The feeder B can house a greater mount of sheets than the sheets housed in the feeding sections 100*a* to *d*. When the feeder B feeds a sheet, the sheet is transported to the expanded receiving section 21 provided at a lower portion of a left side surface of the image forming apparatus 100, and further to the image forming section.

Transport Relay Device C

As shown in FIG. 1, a transport relay device C is provided for transporting sheets of paper to an aftertreatment device D. The transport relay device C is attached to the aftertreatment device D.

The transport relay device C is disposed so as to be rotatable around the aftertreatment device D, a connecting member (first positioning member) for connecting the image forming device 100 and the aftertreatment device D or a rotational axis provided on the aftertreatment device D.

Aftertreatment Device D

As shown in FIG. 1, the aftertreatment device D is disposed on the left side of the image forming apparatus 100, and includes first and second recording material ejecting sections h and i. The first recording material ejecting section h receives an ejected sheet having an image formed thereon from the apparatus 100 at a receive/transport section j provided on an upper portion of a side surface of the aftertreatment device D, and ejects the sheet as it is received. The second recording material ejecting section i ejects a sheet after performing an after treatment by an aftertreatment means such as a stapler or a puncher which is selectively included in the device D.

Though not shown in the figure, the aftertreatment device D may include an aftertreatement section having a function of stapling a predetermined number of sheets, an aftertreatment section having a function of folding a B4 or A3 sized sheet, an aftertreatment section having a function of punching holes for filing, an aftertreatement section having a several to several tens of bins of recording material ejecting sections for sorting or classifying sheets of paper, or the like, and any aftertreament device may be selected.

Recording Material Resupply/Transport Device E

As shown in FIG. 1, the recording material resupply/transport device E is attached to the left side surface of the image forming apparatus 100. The resupply/transport device E is an unit with a recording material transport path for, after a recording material (sheet) having an image formed thereon is ejected from the fixing device 8 and inversely transported using the reverse roller 26 of the ejecting section disposed in the upper portion of the image forming apparatus 100 so that the sides of the sheet are reversed, feeding the sheet again to the transfer section between the photoreceptor drum 3 and the transfer means 6 in the image forming section of the apparatus 100.

Image-Reading Device F

As shown in FIG. 1, an image-reading device F performs exposure and scanning of an original image of a document set on a transparent document supporter to form an image on a photoelectric conversion element, and then converts the image to an electric signal to output the signal as image data. The image-reading device F is also constructed to, when documents are transported through an automatic document transport path by an automatic document transport device G disposed on the image-reading device F, simultaneously scan and read images of the documents from both the top and bottom sides of the documents.

When reading a document from the bottom side thereof, a mobile scanning optical system which usually moves and scans the bottom surface of the document supporter leads an optical image to a CCD which is the photoelectric conversion element so as to scan the image of the document, in the state that the mobile scanning optical system is at a halt at a predetermined position of the document transport path. When simultaneously reading both sides of the document, a contact image sensor (CIS), which is integrally comprised of members such as a light source for subjecting the top surface of the document to exposure, an optical lens leading an optical image to a photoelectric conversion element, and the photoelectric conversion element for converting an optical image into image data, is attached to the automatic document transport device so that the both sides of the document are simultaneously scanned.

The image forming apparatus 100 and its peripheral devices A to G are constructed as described above, and when duplex reading mode is designated, documents set on a feeding section of the automatic document transport device G are sequentially transported, and images are read at substantially the same time.

The image-reading device F has an automatic reading mode and a manual reading mode. In the automatic reading mode, documents as separated sheets are automatically fed by the automatic document transport device G, and exposed and scanned one-by-one in a sequential manner so that images on the documents are read. In the manual reading mode, book-type documents or sheet-type documents which cannot be automatically fed by the automatic document transport device G are manually set and the images thereof are read.

EXAMPLES

The present invention will hereinafter be described by way of examples thereof. However, it should be understood that the present invention be not limited to these examples.

Shown in Table 1 are toner characteristics, evaluation results of the toners used in actual apparatuses according to Examples 1 to 3 and Comparative Examples 1 to 6, and conditions for the evaluations.

| | Toner Characteristics | | | | | | Evaluation Results | | | |
|---|---|---|---|---|---|---|---|---|---|---|
| | Volume Average Diameter μm | Smaller than 4 μm number % | 4 μm-5.04 μm number % | 16 μm or greater volume % | External Additive Amount wt % | External Additive Type | Density | Fogging | Thin Line Reproducibility (%) | Resolution (line/mm) |
| | | | | | | | Measured Value | | | |
| | | | | | | | Evaluation Value | | | |
| | | | | | | | Beginning | | | |
| Ex. 1 | 6.7 | 10 | 25 | 0.5 | 0.55 | Si | 1.45 | 0.33 | 100 | 8.0 |
| | | | | | | | 5 | 5 | 5 | 5 |

-continued

| | | | | | | | | | | |
|---|---|---|---|---|---|---|---|---|---|---|
| Ex. 2 | 6.7 | 10 | 25 | 0.3 | 0.55 | Ti | 1.48 | 0.42 | 102 | 7.1 |
| | | | | | | | 5 | 4 | 5 | 5 |
| Ex. 3 | 7.7 | 8 | 30 | 0.1 | 0.5 | Si | 1.43 | 0.28 | 110 | 6.3 |
| | | | | | | | 5 | 5 | 4 | 4 |
| Comp. | 3.5 | 65 | 25 | 0.05 | 0.9 | Si | 1.25 | 0.66 | 101 | 8 |
| Ex. 1 | | | | | | | 3 | 4 | 5 | 5 |
| Comp. | 10 | 10 | 25 | 1.2 | 0.45 | Si | 1.43 | 0.28 | 133 | 3.2 |
| Ex. 2 | | | | | | | 5 | 5 | 2 | 1 |
| Comp. | 6.7 | 40 | 25 | 0.5 | 0.55 | Si | 1.43 | 0.39 | 101 | 8 |
| Ex. 3 | | | | | | | 5 | 5 | 5 | 5 |
| Comp. | 6.7 | 10 | 15 | 0.5 | 0.55 | Si | 1.4 | 0.55 | 128 | 4.5 |
| Ex. 4 | | | | | | | 5 | 4 | 2 | 3 |
| Comp. | 6.7 | 40 | 15 | 0.5 | 0.55 | Si | 1.36 | 0.37 | 128 | 4.5 |
| Ex. 5 | | | | | | | 4 | 5 | 2 | 3 |
| Comp. | 6.7 | 10 | 25 | 4 | 0.55 | Si | 1.42 | 1 | 118 | 5 |
| Ex. 6 | | | | | | | 5 | 1 | 3 | 3 |

| | Evaluation Results | | | | | |
|---|---|---|---|---|---|---|
| | Density | Fogging | Thin Line Reproducibiliy (%) | Resolution (line/mm) | Toner Consumption (g/5 K) | Overall Result Ave. |
| | Measured Value<br>Evaluation Value<br>After five hundred thousand copies | | | | | |
| Ex. 1 | 1.42 | 0.39 | 103 | 7.1 | 78 | 5.0 |
| | 5 | 5 | 5 | 5 | 5 | |
| Ex. 2 | 1.49 | 0.44 | 105 | 7.1 | 75 | 4.7 |
| | 5 | 4 | 4 | 5 | 5 | |
| Ex. 3 | 1.44 | 0.25 | 113 | 6.3 | 90 | 4.4 |
| | 5 | 5 | 4 | 4 | 4 | |
| Comp. | 1.22 | 2.5 | 140 | 3.2 | 150 | 2.7 |
| Ex. 1 | 3 | 1 | 1 | 1 | 1 | |
| Comp. | 1.45 | 0.55 | 138 | 3.2 | 145 | 2.8 |
| Ex. 2 | 5 | 4 | 1 | 1 | 1 | |
| Comp. | 1.45 | 1.8 | 120 | 4.5 | 148 | 3.7 |
| Ex. 3 | 5 | 1 | 3 | 3 | 1 | |
| Comp. | 1.38 | 0.58 | 130 | 4.5 | 90 | 3.4 |
| Ex. 4 | 4 | 4 | 2 | 3 | 4 | |
| Comp. | 1.4 | 1.9 | 130 | 4.5 | 150 | 2.9 |
| Ex. 5 | 5 | 1 | 2 | 3 | 1 | |
| Comp. | 1.39 | 1.2 | 120 | 4.5 | 85 | 3.0 |
| Ex. 6 | 4 | 1 | 3 | 3 | 4 | |

Density Evaluation

Image density values are obtained by making three copies of a document including a black circle of 55 mm diameter to measure the black portion of each copy sample with a Macbeth densitometer, and then calculating the average of the three copy samples. A higher value indicates a higher density. The density values are evaluated on a scale of five steps as shown below.

Evaluation: Density Value

5: 1.4 or greater

4: 1.3 to 1.4

3: 1.2 to 1.3

2: 1.0 to 1.2

1: 1.0 or smaller

Fogging Evaluation

Whiteness of an A4 sized paper is measured in advance with a whiteness meter (Hunter whiteness meter manufactured by Nippon Denshoku Industries Co., Ltd.) to obtain a first measured value. Then, three copies of a document including a white circle of 55 mm diameter are made, and the whiteness of the obtained copy samples are measured with the above-mentioned whiteness meter. Then, the average whiteness of the three samples are calculated to obtain a second measured value. The second measured value is subtracted from the first measured value to determine the "fogging" value. A higher value indicates that there is more fogging.

Evaluation: Fogging Value

5: 0.4 or smaller

4: 0.6-0.4

3: 0.8-0.6

2: 1.0-0.8

1: 1.0 or greater

Thin Line Reproducibility Evaluation

A copy of a document on which a thin line with a line width of exactly 100 μm is written is made as a measurement sample, under the conditions that a copy image of an original image including a halftone circle having a diameter of 5 mm and an image density of 0.3 can be made with an image density of 0.3 to 0.5. Using Luzex 450 Particle Analyzer as a measuring instrument, the line width of the sample is measured by means of an indicator on an enlarged image displayed on a monitor. Since the image of the thin line is uneven in a width direction, an average line width is taken as a measured value. The obtained measured line width of the copy is divided by the line width of the original document and the result is multiplied by 100 to obtain a thin line reproducibility value (%). A value closer to 100% indicates better thin line reproducibility.

Evaluation: Thin Line Reproducibility Value (%)

5: 100 to smaller than 105

4: 105 to smaller than 115

3: 115 to smaller than 125

2: 125 to smaller than 135

1: 135 or greater

Resolution Evaluation

A number of original images are made in which patterns of five thin lines with equal line width and distance are drawn in respective images so that R=2.8, 3.2, 3.6, 4.0, 4.5, 5.0, 5.6, 6.3, 7.1 and 8.0 lines/mm are provided in 1 mm, respectively. R signifies the resolving power and is represented by R=½d (wherein d is a thin line width). Copies of the images of the above 10 types of lines are made under appropriate reproduction conditions and are observed with a magnifying glass. The number (line number/mm) of lines clearly separated from the other lines is determined as a resolution. A higher value indicates a higher resolution.

Evaluation: Number of Lines (Line Number/mm)

5: 7.1, 8.0
4: 5.6, 6.3
3: 4.5, 5.0
2: 3.6, 4.0
1: 3.2 or less

Toner Consumption Evaluation

The toner consumption is determined by measuring the amount of toner used in continuously making 5000-sheet copies with an actual apparatus.

Evaluation: Toner Consumption

5: less than 80 g
4: 80 to less than 100 g
3: 100 to less than 120 g
2: 120 g or greater to less than 140 g
1: 140 g or greater Overall Evaluation An average of the evaluated values in the above items is obtained as an overall evaluation for each of the Examples and Comparative Examples. The toner with an average value of 4 or higher and without the lowest rating is judged as the toner which passed the overall evaluation.

Components included in the toner of Examples 1-3 and Comparative Examples 1-6 and their preparation processes are described below.

Examples 1-3 and Comparative Examples 1-6

| | |
|---|---|
| Crosslinked polyester resin (THF insoluble component: 30 percent by weight) | 100 parts by weight |
| Carbon black (#44 manufactured by Mitsubishi Chemical Corporation, particle diameter: 24 nm) | 10 parts by weight |
| Charge control agent (BONTRON(R)S-34 manufactured by Orient Chemical Industries, Ltd.) | 4 parts by weight |
| Wax (Hi-Wax 4051E manufactured by Mitsui Chemicals, Inc.) | 3 parts by weight |

50 kg of a material containing each component in the above-mentioned ratio was mixed in a Henschel mixer for 5 minutes at a rotor speed of 400 rpm. The resulting mixture was melted and kneaded in an extruder (PCM-65 manufactured by Ikegai Ltd.) The operation conditions were set as follows. Cylinder set temperature: 100° C.; number of barrel revolution: 300 rpm; material feed speed: 100 kg/h. After the resulting toner mixture was cooled by a cooling belt, it was roughly crushed by a speed mill having a screen of f3 mm. Then, the crushed mixture was further grinded by a fluid bed type air pulverizer (manufactured by Mitsui Mining Co., Ltd.), and fine powder and coarse powder are cut by a rotor classifier (manufactured by Mitsui Mining Co., Ltd.) to provide a toner having an average particle diameter ($D_{50}$) of 6.7 μm.

In Examples 1-3 and Comparative Examples 1-6, the particle diameter, volume average diameter, percent by number and percent by volume of toners are controlled by the operation conditions of the pulverizer and the classifier which are set differently from each other.

The obtained toner was measured as described above by a coulter counter TA-II having a 100 μm aperture.

0.5 parts by weight of hydrophobic dry silica (BET specific surface area: 200 $m^2/g$) was added to 100 parts by weight of the obtained toner in the form of fine black powder, and mixed in a Henschel mixer. 4 parts by weight of the toner with external additive was mixed with 96 parts by weight of ferrite carriers having a volume average diameter of 95 μm to obtain a negatively-charged nonmagnetic two-component developer.

The particle diameter distribution and the characteristics of the toner are shown in Table 1.

The two-component developer prepared was set in a copier AR-620 (manufactured by Sharp Corporation), and an image forming test was carried out in which prepared were an early toner image (first copy) and a toner image obtained after continuously making five hundred thousand copies.

Table 1 shows that the overall evaluation results are 4 or higher for Examples 1-3 which satisfy the toner characteristics of the present invention. The toners of these Examples are excellent in high image density, fogging prevention, thin-line reproducibility, resolution and toner consumption reduction. On the other hand, the overall evaluation results are below 4 for Comparative Examples 1-6 which do not satisfy the toner characteristics of the present invention. The toners of Comparative Examples have a problem in at least one of image density, fogging prevention, thin-line reproducibility, resolution and toner consumption reduction.

As described hereinabove, the toner of the invention can be used in a copier or a printer.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, comprising toner particles in which not more than 13 percent by number of the toner particles have a particle diameter of smaller than 4 μm, not less than 20 percent by number of the toner particles have a particle diameter of 4 μm to 6 μm, not more than 2.0 percent by volume of the toner particles have a particle diameter of 16 μm or greater, wherein the toner particles have a volume average diameter of 4 μm to 9 μm and at least an external additive is added to the toner particles.

2. The toner according to claim 1, wherein not more than 10 percent by number of the toner particles have a particle diameter of smaller than 4 μm, not less than 25 percent by number of the toner particles have a particle diameter of 4 μm to 5.04 μm, not more than 0.5 percent by volume of the toner particles have a particle diameter of 16 μm or greater, and the toner particles have a volume average diameter of 6.7 μm to 7.7 μm.

3. The toner according to claim 1, wherein the external additive is fine silica powder with an average particle diameter of 4 μm or smaller, and the additive is added in an amount of 0.01 to 8 parts by weight relative to 100 parts by weight of the toner particles.

4. The toner according to claim 1, wherein the toner is used together with magnetic carriers as a two-component developer.

5. The toner according to claim 4, wherein the magnetic carriers have a volume average diameter of 30 μm to 100 μm and are used in an amount of 10 to 1000 parts by weight relative to 10 parts by weight of the toner.

6. The toner according to any one of claims 1 or 4 which is used in an image forming apparatus, the image forming apparatus comprising:

an image bearing member;

electrostatic latent image forming means for forming an electrostatic latent image on the supporter;

developer supply means for supplying a developer to the supporter to form a toner image;

transportation means for transporting a transfer material to a transfer position on the supporter; and transfer means for transferring the toner image from the supporter to the transfer material at the transfer position.

7. An image forming method comprising the steps of:

forming an electrostatic latent image on an image bearing member;

supplying to the image bearing member a two-component developer containing at least a toner and magnetic carriers to form a toner image; and transferring the toner image to a transfer material, wherein the toner comprises a toner according to claim 1.

* * * * *